US008930091B2

(12) United States Patent
Upcroft et al.

(10) Patent No.: US 8,930,091 B2
(45) Date of Patent: Jan. 6, 2015

(54) MEASUREMENT OF BULK DENSITY OF THE PAYLOAD IN A DRAGLINE BUCKET

(75) Inventors: Benjamin Upcroft, Brisbane (AU); Rajiv Chandra Shekhar, Brisbane (AU); Alex Joseph Bewley, Brisbane (AU); Paul J. A. Lever, Brisbane (AU)

(73) Assignee: CMTE Development Limited, Pinjarra Hills (AU)

( * ) Notice: Subject to any disclaimer, the term of this patent is extended or adjusted under 35 U.S.C. 154(b) by 0 days.

(21) Appl. No.: 13/281,328

(22) Filed: Oct. 25, 2011

(65) Prior Publication Data

US 2012/0136542 A1 May 31, 2012

Related U.S. Application Data

(60) Provisional application No. 61/406,956, filed on Oct. 26, 2010.

(51) Int. Cl.
*G06F 19/00* (2011.01)

(52) U.S. Cl.
USPC ..... 701/50; 37/348; 37/32 R; 37/396

(58) Field of Classification Search
USPC ..... 37/347–348, 398, 401, 32 R; 702/173–174; 701/50, 99
See application file for complete search history.

(56) References Cited

U.S. PATENT DOCUMENTS

| | | | | |
|---|---|---|---|---|
| 5,848,485 | A | 12/1998 | Anderson et al. | |
| 6,108,076 | A | 8/2000 | Hanseder | |
| 6,225,574 | B1 | 5/2001 | Chang et al. | |
| 6,263,595 | B1 * | 7/2001 | Ake | 37/348 |
| 6,446,366 | B1 * | 9/2002 | Briscoe et al. | 37/398 |
| 6,550,163 | B2 * | 4/2003 | Briscoe et al. | 37/398 |
| 6,705,031 | B2 * | 3/2004 | Briscoe et al. | 37/398 |
| 7,079,931 | B2 | 7/2006 | Sahm et al. | |

(Continued)

FOREIGN PATENT DOCUMENTS

| | | | |
|---|---|---|---|
| AU | 2010236018 | A1 * | 5/2012 |
| CA | 2720080 | A1 * | 4/2012 |

(Continued)

OTHER PUBLICATIONS

Real-time volume estimation of a dragline payload; Shekhar, R.et al.; Robotics and Automation (ICRA), 2011 IEEE International Conference on; o Digital Object Identifier: 10.1109/ICRA.2011.5979898; Publication Year: 2011 , pp. 1571-1576 IEEE Conference Publications.*

(Continued)

*Primary Examiner* — Cuong H Nguyen
(74) *Attorney, Agent, or Firm* — Perkins Coie LLP

(57) ABSTRACT

In particular embodiments of the technology, the bulk density of the payload in the bucket of a large electric dragline is measured during the carry phase of dragline operation by scanning the loaded bucket using a boom mounted scanner to provide data relating to the volume of the loaded bucket. Suitable methods can further include calculating the volume enclosed by the surface of the payload and the known base and sides of the bucket to give payload volume, and dividing the payload volume into payload weight data derived from rope length and motor current data to give the payload bulk density. Methods of screening data points originating from surfaces other than the bucket and payload, and methods of dealing with bucket ope and sway are also described and claimed.

21 Claims, 8 Drawing Sheets

(56) References Cited

U.S. PATENT DOCUMENTS

| | | | | |
|---|---|---|---|---|
| 7,669,354 | B2 * | 3/2010 | Aebischer et al. | 37/348 |
| 7,832,126 | B2 * | 11/2010 | Koellner et al. | 37/348 |
| 8,355,847 | B2 * | 1/2013 | Colwell et al. | 701/50 |
| 8,504,253 | B2 * | 8/2013 | Stantchev et al. | 701/50 |
| 8,504,255 | B2 * | 8/2013 | Colwell et al. | 701/50 |
| 8,515,708 | B2 | 8/2013 | McAree et al. | |
| 8,527,158 | B2 * | 9/2013 | Faivre et al. | 701/50 |
| 8,571,766 | B2 * | 10/2013 | Colwell et al. | 701/50 |
| 8,620,533 | B2 * | 12/2013 | Taylor | 701/50 |
| 8,620,536 | B2 * | 12/2013 | Colwell et al. | 701/50 |
| 8,682,542 | B2 * | 3/2014 | Colwell et al. | 701/50 |
| 2007/0006492 | A1 * | 1/2007 | Rowlands | 37/348 |
| 2008/0005938 | A1 * | 1/2008 | Aebischer et al. | 37/413 |
| 2008/0282583 | A1 * | 11/2008 | Koellner et al. | 37/348 |
| 2012/0136542 | A1 * | 5/2012 | Upcroft et al. | 701/50 |

FOREIGN PATENT DOCUMENTS

| | | | |
|---|---|---|---|
| WO | WO-9305479 | A1 | 3/1993 |
| WO | WO-2008091395 | A2 | 7/2008 |
| WO | WO 2008144043 | A2 * | 11/2008 |

OTHER PUBLICATIONS

E. Duff, "Automated Volume Estimation of Haul-Truck Loads", Proceedings of the Australian Conference on Robotics and Automation, 2000, pp. 179-184.*

Field and service applications—Dragline automation—A dedade of development—Shared Autonomy for Improving Mining Equipment Productivity; Winstanley, G.; Usher, K.; Corke, P.; Dunbabin, M.; Roberts, J.; Robotics & Automation Magazine, IEEE vol. 14 , Issue: 3; Digital Object Identifier: 10.1109/MRA.2007.901315 Pub.Year: 2007 , pp. 52-64.*

C. H. McInnes, and P. A. Meehan, "A four degree of freedom dynamic dragline model for predicting duty and optimising bucket trajectory". CRC Mining Technology Conference. Perth, WA, Australia: The Australasian Institute of Mining and Metallurgy, 2007.*

P. Ridley, and P Corke, "Calculation of dragline bucket pose under gravity loading". Mechanism and Machine Theory, vol. 35, 2000, pp. 1431-1444.*

Improving path planning and mapping based on stereo vision and lidar;Moghadam, P.; Wijesoma, W.S.; Dong Jun Feng Control, Automation, Robotics and Vision, 2008. ICARCV 2008. 10th International Conference on; Digital Object Identifier: 10.1109/ICARCV.2008.4795550; Publication Year: 2008 , pp. 384-389.*

94 GHz Waveguide VCO for FMCW radar;Dong Sik Ko et al.; Millimeter Waves, 2008. GSMM 2008. Global Symposium on; Digital Object Identifier: 10.1109/GSMM.2008.4534553; Publication Year: 2008, 2008 , pp. 44-47.*

Recent advances in 94 GHz FMCW imaging radar development; Goshi, D.S. et al., Microwave Symposium Digest, 2009. MTT '09. IEEE MTT-S Inter.; Digital Object Identifier: 10.1109/MWSYM.2009.5165636; Publication Year: 2009 , pp. 77-80.*

Real-time volume estimation of a dragline payload; Bewley, A.; Shekhar, R.; Leonard, S.; Upcroft, B.; Lever, P.; Robotics and Automation (ICRA), 2011 IEEE International Conference on; DOI: 10.1109/ICRA.2011.5979898; Publication Year: 2011, pp. 1571-1576.*

Control of the main working axes of bucket wheel excavators according to the criterion of desired capacity; Rasic, N.; Bebic, M.; Ristic, L.; Jeftenic, B.; Statkic, S.; Industrial Electronics Society, IECON 2013—39th Annual Conference of the IEEE DOI: 10.1109/IECON.2013.6699680; Publication Year: 2013 , pp. 3433-3438.*

Input Test Data VolumeReduction for Skewed-Load Tests by Additional Shifting of Scan-In States; Pomeranz, I.; Computer-Aided Design of Integrated Circuits and Systems, IEEE Transactions on; vol. 33, Issue: 4; DOI: 10.1109/TCAD.2013.2290085; Publication Year: 2014, pp. 638-642.*

Wauge, D., "Payload Estimation for Electric Mining Shovels," School of Engineering, The University of Queensland, PhD Thesis, Australia, 2007, 246 pages.

* cited by examiner

MEASUREMENT OF BULK DENSITY OF THE PAYLOAD IN A DRAGLINE BUCKET

CROSS-REFERENCE TO RELATED APPLICATION

The present application claims priority to U.S. Provisional Application No. 61/406,956, filed Oct. 26, 2010, and incorporated herein by reference.

TECHNICAL FIELD

This invention relates to the measurement of bulk density of the payload in a dragline bucket and has been devised particularly though not solely for assessing the dig and blast performance of overburden removal in an open-cut mine.

Large electric draglines are typically used in open-cut mining to remove overburden after blasting operations and to shape the configuration of the open-cut pit.

BACKGROUND

The requirement for any dragline is to move the largest amount of material per unit time, typically measured in tonnes per hour. High productivity achieved at the cost of high or undesirable loads on the dragline will generate increased maintenance costs and downtime so it is therefore important not to overload the bucket of a dragline in order to increase productivity. Research has indicated that the bulk density of blasted material in a dragline pit can vary greatly depending on blast performance, particularly in throw blasts. This variation has a significant effect on bucket size required to achieve desired or optimal payload (thus rated suspended load) as well as the digability of the material.

It is desirable to provide accurate estimates of the bulk density in order to provide the benefits of reliable assessment of dig and blast performance, improved bucket size selection to achieve consistent suspended load targets, and decreased production costs by reduced dragline damage and improved productivity through reduced probability of bucket overloads.

Although work has been done in the past in determining material density in other open pit mining situations such as in excavator buckets or in haul trucks, it is extremely difficult to provide real-time density determination in a dragline bucket due to the difficulty in determining the accurate bucket pose estimation, payload extraction, and filtering. The bucket is attached to free moving ropes and thus the dynamics of the bucket at any point in time are unknown.

The bulk density of the payload material in the bucket of a dragline is typically determined by measuring payload weight and dividing that weight by payload volume. Determination of payload weight is reasonably well known and able to be determined from proprietary products which measure rope lengths and motor currents to determine the load on the dragline hoist ropes at any point in time and hence enable calculation of the weight of the payload in the dragline bucket. The main objective of the present invention is to provide a method of accurately determining the volume of the payload in the bucket during the carry phase of the dragline dig and dump cycle in order to allow real-time calculation of the bulk density of the material in the dragline bucket.

SUMMARY

Accordingly, the present invention provides a method of measuring the bulk density of the payload in a dragline bucket during dragline operation, comprising the steps of scanning a loaded dragline bucket during an operating cycle of the dragline to provide mathematical data relating to the volume of the loaded bucket, calculating the volume enclosed by the surfaces of the payload and the known base and side surfaces of the bucket from the mathematical data to give the payload volume, and dividing the payload volume into the payload weight to give the payload bulk density.

In particular embodiments, the process of scanning the loaded bucket during an operating cycle of the dragline occurs during the carry phase of the cycle, between the lifting phase and the dumping phase.

In particular embodiments, the process of scanning the loaded bucket is performed by moving the bucket during the carry phase through the beam of a suitable scanner.

In particular embodiments, the suitable scanner comprises a laser scanner.

In other embodiments, suitable scanner comprises a radar scanner.

In particular embodiments, the mathematical data is analysed to screen out data points originating from surfaces other than those of the bucket and the payload.

In particular embodiments, the process of calculating the volume enclosed by the surface of the bucket and the known base and side surfaces of the bucket includes analysing the collected data to rebuild the bucket structure by estimating the bucket motion between scans to allow for bucket sway.

In particular embodiments, the process of calculating the volume of the loaded bucket includes the steps of collecting hoist and drag rope length data and using that data to determine the bucket displacement between each scan.

In other embodiments, the process of determining the volume of the loaded bucket includes measuring the displacement between each scan as a function of bucket velocity as it passes through the scanner beam and using the displacement to rescale bucket points in a direction orthogonal to the scanner beam.

In particular embodiments, the processes of calculating the volume enclosed by the surface of the payload and the known base and sides of the bucket include determining the pose of the loaded bucket in order to provide reference surface data and enable known features of the bucket to be deducted from the volume calculation.

In particular embodiments, the payload volume is determined using an elevation map representation.

Notwithstanding any other forms that may fall within its scope, one preferred embodiment of the invention will now be described with reference to the accompanying drawings in which

DETAILED DESCRIPTION

Figure 9:
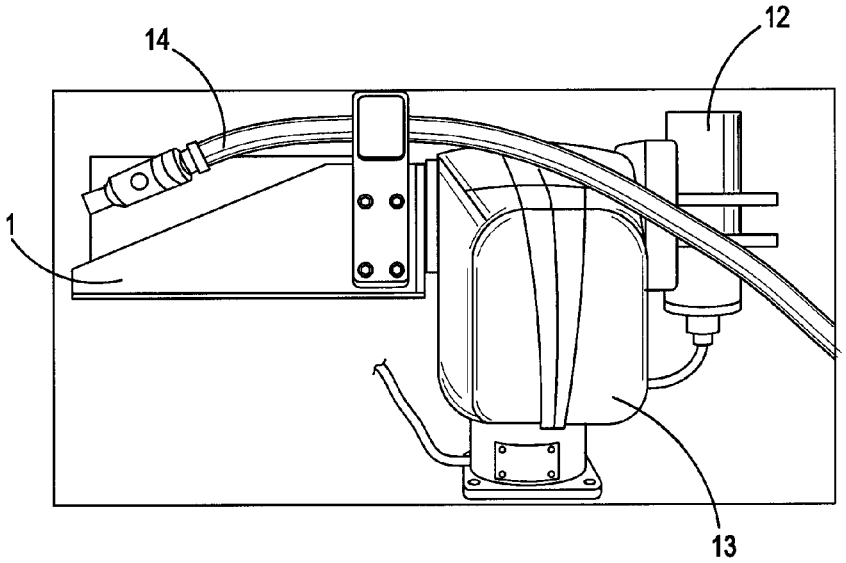
FIG. 9 is an elevation showing the sensors assembled on the Pan Tilt Unit.

In the preferred form of the invention, a laser scanner 1 (FIG. 9) is mounted at 2 on the boom 3 of a large electric dragline 4 (FIG. 7) in order to scan a loaded dragline bucket 5 as it passes through the beam of the laser scanner during the carry phase in the cycle of dragline operation, between the lifting phase and the dumping phase.

Accurate scanning of the loaded bucket poses a number of problems, exacerbated by the fact that the bucket is suspended from the dragline boom by hoist ropes 6 which allow degrees of movement of the loaded bucket during the carry phase, and also because the bucket and the scanner pass over varying terrain 7 during the carry phase as the dragline house rotates about its base.

These constraints and problems require a very difficult analysis as is set out and explained in the following section.

Bucket Detection

The foremost step to measuring the in-bucket payload volume is to firstly scan and identify the bucket. Bucket detection is critical to isolate the relevant data from background noise such as points from the terrain. Each point is assigned to a specific class; terrain, bucket or noise. Since we are only interested in the terrain and the bucket (namely the payload) other items such as hoist and drag ropes are discarded as noise.

Figure 1:
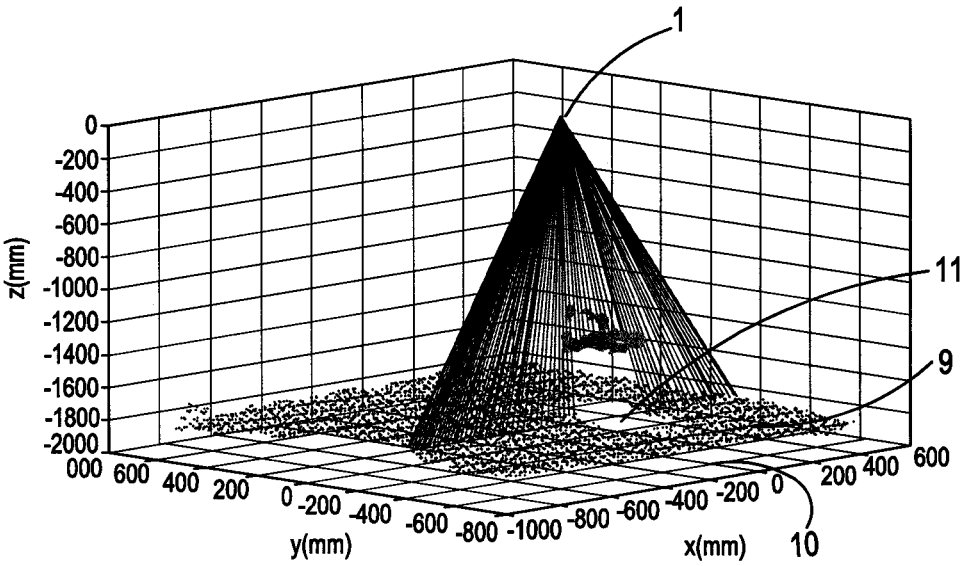
FIG. 1 is a laser beam visualisation of the bucket passing through the beam.

This can be seen in FIG. 1 where the beam from the laser at 8 casts a shadow 9 on the ground 10, revealing the outline of the bucket at 11.

Figure 2:
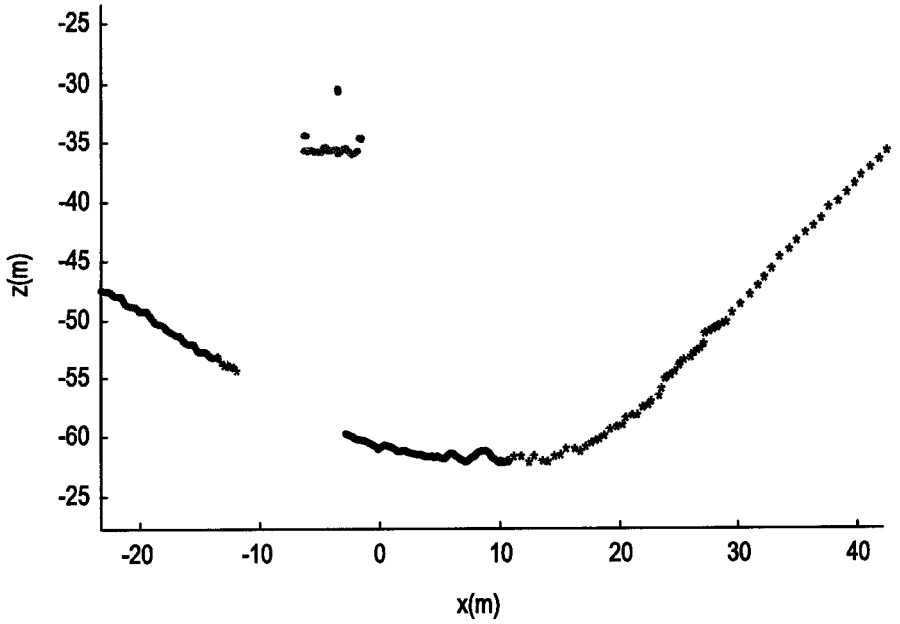
FIG. 2 is a plot of a scan at the bucket.

After major clusters are identified, the number of major clusters in each scan is used to determine the presence of the bucket. For example:

The invention uses point clustering techniques to identify similar points within the scan to improve the performance of data classification and overcome typical thresholding issues (see FIG. 2). The individual clusters are classified by their overall shape an dimensions as expected for bucket and terrain.

Bucket Reconstruction

Due to the typical swing motion of the dragline, the bucket can exhibit extensive out-of-plane motion referred to as bucket sway. This kind of motion produces an artefact resembling a wavy shaped bucket that is caused by the lengthy duration (of approximately 2 seconds) for the bucket to pass through the beam. As a consequence the bucket data from each scan line is to some extent shifted with respect to the previous scan line. This step analyses the collected bucket data to rebuild the bucket structure by estimated the bucket motion between scans.

Sway Correction

Figure 4:
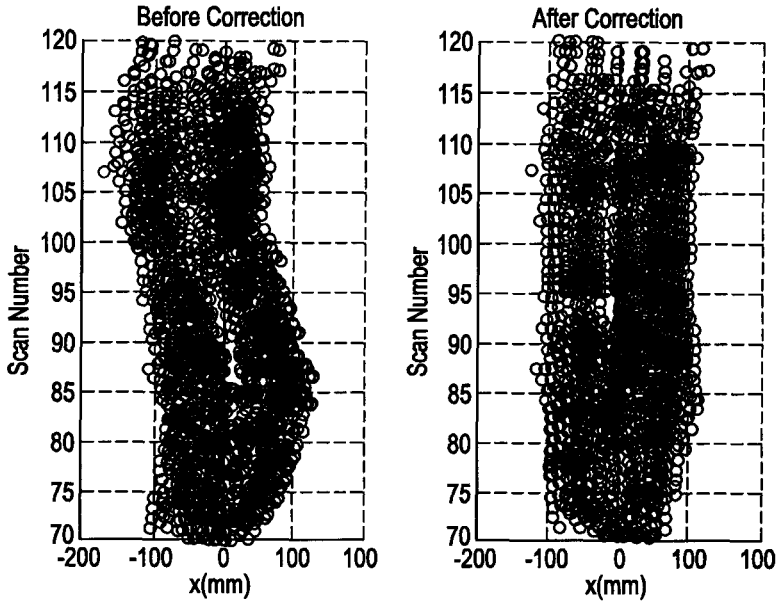
FIG. 4 is a plot of the x co-ordinates before and after sway correction.

The amount of bucket sway was measured by the translation of bucket points between scans. This was critical to determine the required transformation used to recover the actual bucket shape. The bucket points of each scan are translated by their mean x coordinate, which centre points about x=0 as shown in FIG. 4

Figure 3:
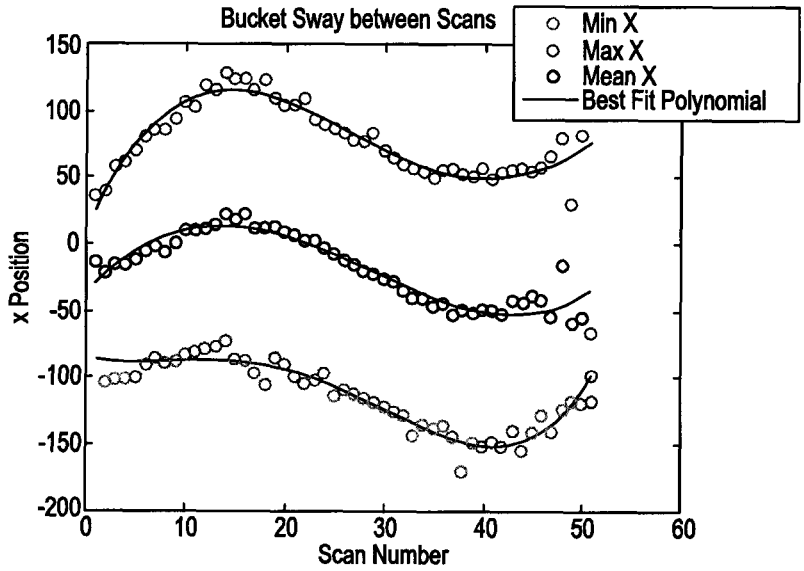
FIG. 3 is a plot of bucket sway over various scans.

Irregulatirties in the payload profile can cause significant changes in the mean x coordinate between scans as seen in FIG. 3 by the outlying points. These outlyers inflict a rapid and incorrect change in the estimated motion of the bucket. The estimated motion of the bucket is smoothed by applying either a polynomial or sine wave fit to the mean x coordinates of each scan.

Rescaling

The displacement between each scan is a function of the bucket velocity as it passes through the laser beam. This displacement is used to rescale the bucket points in the direction orthogonal to the laser beam. Assuming the bucket passes through the beam at a constant velocity the displacement of the bucket between scans can be deduced as follows:

$$\Delta y = \frac{l\cos\delta}{n-1}$$

Where/is the known length of the bucket, δ is the carry angle of the bucket (determined by the rigging), and n is the number of scans taken of the bucket.

An interface to the hoist and drag rope lengths supplied through the onboard DCS monitor allowed for a more direct approach to evaluating the translation between scans. Between each scan the lengths of the extended hoist and drag ropes is used to estimate the Cartesian position of the bucket relative to the machine. This method is capable of measuring any change in velocity of the bucket during the scanning process. However, up-to-date rope length offsets are required to make this approach feasible. Generally, these, are entered into the dragline monitor software after each rope cropping, however this wasn't made available on the PLC interface. In practice, the bucket position as measured from the laser was used to estimate the offsets.

Pose Estimation

The pose of the bucket is required in later steps to filter out known features of the bucket in addition to providing a reference surface to calculate the volume of the payload. Two methods for determining the pose of the bucket have been investigated on the scaled system, with the second trialled on a full scale dragline.

Figure 5:
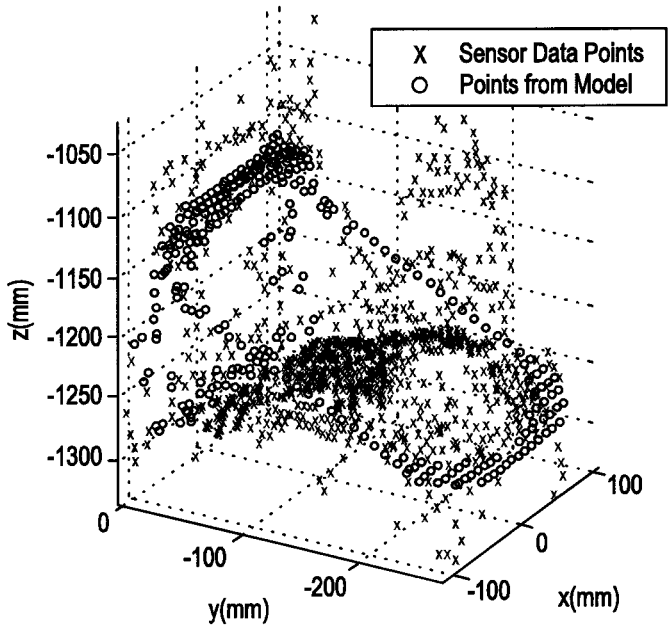
FIG. 5 is a three dimensional plot of ICP model fitted to reconstructed data points.

The first method involves placing four reflectors at known locations on the bucket which are segmented from rest of the scan based on the intensity of the returns. Laser retro-reflector tape was used as it provides a high intensity reading and allows for intensity based segmentation. Often there are multiple returns per reflector and the localised mean of these returns are used to define the location of these reflectors. These points are matched to the reflector locations in the bucket frame and by using a Levenberg-Marquardt numerical solver, the pose of the bucket is computed. Problems with this method are that some reflectors are often occluded and for the full scale application would not be able to withstand the harsh environment. This option is commercially unfeasible any future dragline buckets with this system installed would need reflectors welded across their arch and rim. In addition to this the small amount of reference points used resulted in a large transformation error that forms a basis for the volume calculation error exceeding 10%. The second method of using ICP was chosen in an attempt to overcome the drawbacks of using reflectors. ICP better fits a model point set to the entire bucket point cloud as shown in FIG. 5.

Payload Extraction

Payload points need to be segmented from other points on the bucket such as the bucket arch, spreader bar and jewellery while taking into account noisy outliers. This process is summarised by firstly removing known features of the bucket such as the arch of the bucket. Next, the algorithm is used to filter out noise and identify clusters representing the payload.

Finally points are added to the payload in regions occluded by the sensor to ensure full coverage of the bucket surface.

Bucket Feature Filtering

Using the bucket pose information, particular features such as the arch and rim of the bucket can be removed as they are not part of the payload. These known features are stored in the form of a cylinder represented by two points (at the centre of each circular face) and a radius. The points are transformed into the sensor frame using the bucket pose and any data point enclosed by a feature cylinder is removed.

Cluster Density Segmentation

The payload points are characterised by a large regions of high density within the point cloud due to the surface being rather orthogonal to the ray produced by the sensor. The previous step of removing known features such as the arch and rim of the bucket would also reduce the point density in these regions. This leaves the payload points as the largest high density point clusters in the remaining sample set.

Addition of Occluded Points

Due to the effects of shadowing caused by the arch and spreader bar, the outer boundary of the bucket's payload is often occluded. This effectively reduces the area covered by the visible payload points and thus reduces the total sensed volume of the points. By using the pose estimation of the bucket we can assume that the payload forms a continuous smooth surface up to the inner edges of the bucket. Points near the transformed bucket teeth are added to the payload. This ensures that the payload volume is continuous from the sensed payload to the teeth after interpolation. Similarly points positioned on the inner rear surface of the bucket are added as this region is often occluded by the spreader bar.

Volume Measurement

With the payload points subdivided from the bucket, and the bucket's pose known, the payload volume can be measured. A relatively straightforward method for representing a surface is the height grid (or elevation map) representation. The grid is constructed by dividing up the area (in x, y plane) covered by the point cloud into uniformly sized cells. The height value at each cell is equal to the average z value of all points with x, y values bounded by the cell.

Shadows from the arch and spreader bar may cause some cells to contain no points and thus leave the height undefined. To overcome this, an interpolation method is used to fill in the missing data between the known cells, forming a convex shape in the x, y projection of the grid.

To calculate the volume of the payload, a reference surface of the inside of an empty bucket is required. This is found by transforming a pre-computed height grid generated from a bucket CAD model by the pose estimated from ICP. This height grid now represents the bottom surface of the payload against the base of the bucket.

The volume between the payload height grid and the reference height grid is computed by summing the height differences over the aligned cells multiplied by the cell area.

Results of Pilot Studies

The simulated payload material has relatively uniform granule size to ensure minimal compaction when transferring from the measuring apparatus to the bucket. The material is measured independently before each scan and after with any discrepancy averaged to ensure an accurate ground truth measurement.

Figure 6:
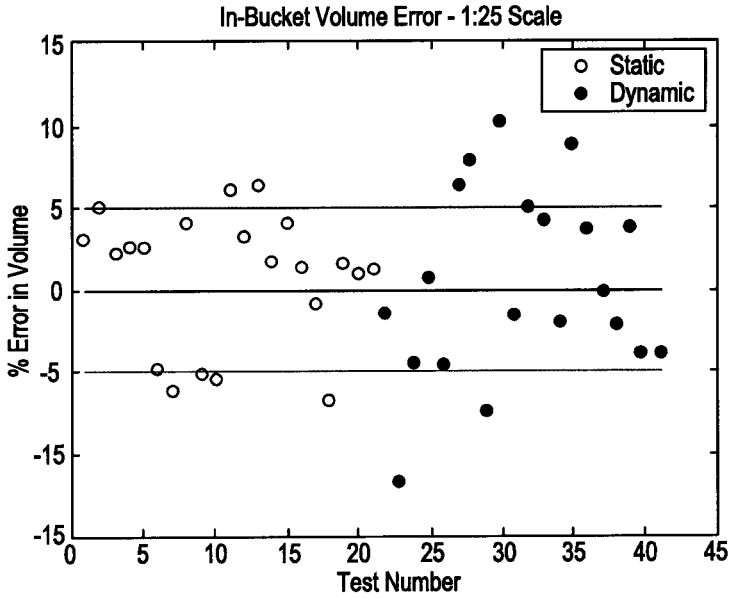
FIG. 6 shows the results of scans taken in dragline bin.

The velocity of each run and the material is slightly varied to test the robustness of the algorithms. When the bucket is swaying the variance of the volumes slightly increases as seen in FIG. 6, but maintains minimal bias.

TABLE 1

Result summary with error expressed as a percentage of bucket capacity.

| | Static Runs | Dynamic Runs | All Runs |
|---|---|---|---|
| RMS Error | 4.1% | 5.6% | 4.9% |
| Mean Error | 0.8% | 0.3% | 0.5% |
| Standard Deviation | 4.1% | 5.8% | 4.9% |

System Design

Overview

Figure 7:
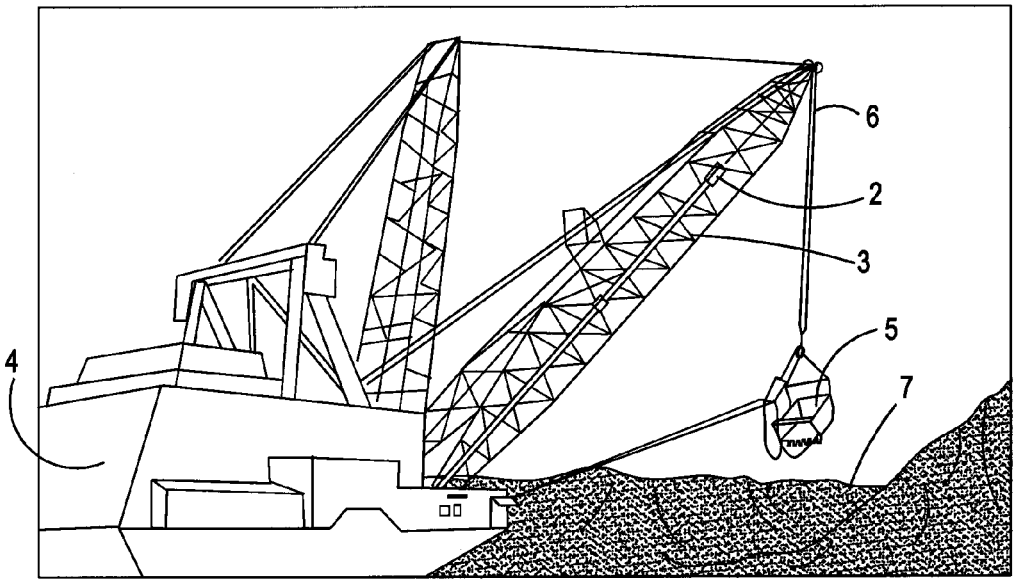
FIG. 7 is a perspective view of a dragline in use, showing the location of hardware used in the invention.

FIG. 7 gives a brief overview of the system hardware. The system is comprised of two primary elements, the first being a number of sensors mounted on the boom 3, and the second being equipment housed in the dragline's control room.

Scanner

The primary sensor of the system is the scanner, used to generate a "point cloud" image of the payload in the dragline bucket, as well as the surrounding terrain. Two options considered were a 94 GHZ FMCW radar and the Sick LD-MRS Laser, a commercial off the shelf scanning laser.

Table 2 compares key performance criteria of both sensors, including the radar with a proposed upgrade.

The LD-MRS Laser scanner was the sensor chosen for this project, as simulations showed it to be able to scan the dragline bucket payload with greater accuracy. A description of both sensors, as well as further details of the criteria applied for selection between them is given below.

TABLE 2

Scanner Performance Comparison

| | Radar | Upgraded Radar | Laser |
|---|---|---|---|
| Max Range (m) | 300 | 300 | 200[1] |
| Scanning Frequency (Hz) | 4.5 | 10 | 12.5 |
| Angular Resolution (deg) | 0.81 | 0.37 | 0.25 |
| Range Accuracy (m) | 0.5 | 0.5 | 0.1 |
| Beam Width (deg) | 1.49 | 0.89 | 0.8/0.08[2] |

(Notes:
[1]The actual maximum range of the laser is dependent on the reflectivity of the surface being scanned.
[2]Vertical/Horizontal beam width).

Radar

The primary advantage of the 94 GHz frequency modulated continuous-wave (FMCW) radar is its immunity to adverse environmental conditions. As the millimeter wave beam can penetrate dust and water particles, it can produce images even under zero visibility conditions. However, critical weaknesses of the radar are its poor angular resolution, range accuracy, and scan speed.

Laser

The Sick LD-MRS, formerly a product of IBEO is a scanning laser designed for use in the automotive industry. The laser offers far greater range accuracy and angular resolution than the radar. Additionally the LDMRS is capable of simultaneously producing four scanning planes and recording up to three echoes per transmitted pulse. These features provide some immunity to environmental conditions such as dust and rain, but not to the same degree as the radar.

Scanner Selection

Figure 8:
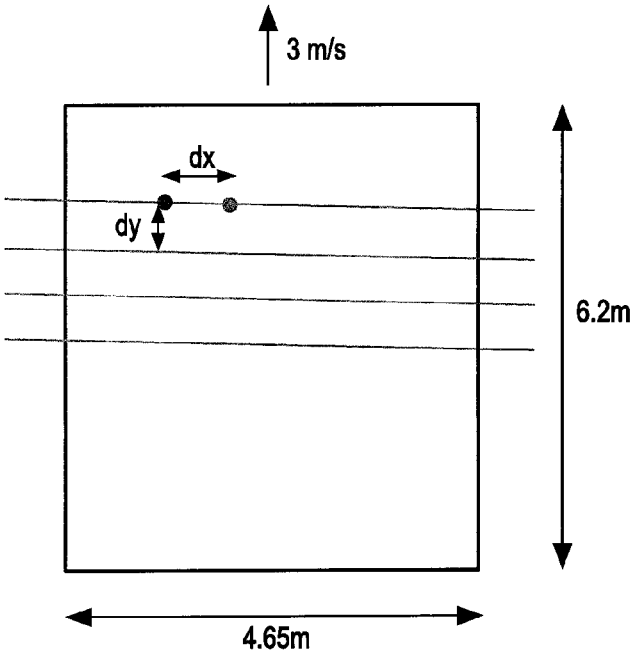
FIG. 8 is a simulation of the bucket moving through the scan plane.

The main criterion for the selection of a 3D Scanner was the ability to accurately calculate the volume of the dragline bucket payload. To compare the performance of both sensors accordingly, a simulation of the volume calculation was performed. The simulation approximates the expected sampled surface of a typical bucket moving through the scan plane at a rate of 3 m/s (nominal velocity of bucket during swing cycle), using the performance statistics of Table 2. The simulation scenario is illustrated in FIG. 8. The results of this simulation are shown in Table 3.

TABLE 3

Simulation Results

| | Radar | Upgraded Radar | LD-MRS* | |
|---|---|---|---|---|
| dx (across width) | 0.71 | 0.32 | 0.22 | m |
| dy (down length) | 0.67 | 0.30 | 0.24 | m |
| Points across width | 7 | 15 | 21 | points/line |
| Lines down length | 9 | 21 | 26 | lines |
| Total points on bucket | 63 | 315 | 546 | points |
| Simulated Volume Error# | 10.18 | 8.84 | 3.55 | % |

The simulation clearly shows the Sick LD-MRS Laser as the only sensor expected to produce a volume accurate to within the acceptable level of 5%. Furthermore, as the upgraded radar did not produce a markedly better results, it can be surmised that the radar's poor range accuracy was the limiting factor. Some caveats of the simulation that should be noted are:

- The simulator does not include effect of: Shadowing, Bucket Dynamics or segmenting payload from bucket features, and
- The dragline bucket payload was approximated by a simple box.

Navigation Sensor

The navigation sensor chosen for this project was the Xsens MTi-G. This sensor combines a GPS receiver and Inertial Measurement Unit, allowing it to operate with an intermittent GPS signal. The sensor provides 6 degree-of-freedom position and orientation, with a position accuracy of 2.5 m. While this accuracy does not compare favourably to the real time kinematic (RTK) navigation systems, it was deemed sufficient, as this project's primary objective of in-bucket volume measurement did not require highly accurate navigation sensing.

Sensor Assembly

The Sick LD-MRS Laser, along with an off the shelf IP camera 12, were mounted to a Directed Perception PTU-D100 Pan Tilt Unit (PTU) 13. Although the scanner was held stationary for the purpose of scanning the dragline bucket, the PTU allowed fine tuning of the scan plane angle on the fly, as well as the scanning of the terrain. In anticipation of possible dust issues, the mounted laser 1 was enclosed in a protective enclosure with a compressed air purge line 14. The laser 1, camera 12 and PTU 13 are shown fully assembled in FIG. 9, as mounted at 2 on the dragline boom 3 (FIG. 7).

Figure 10:
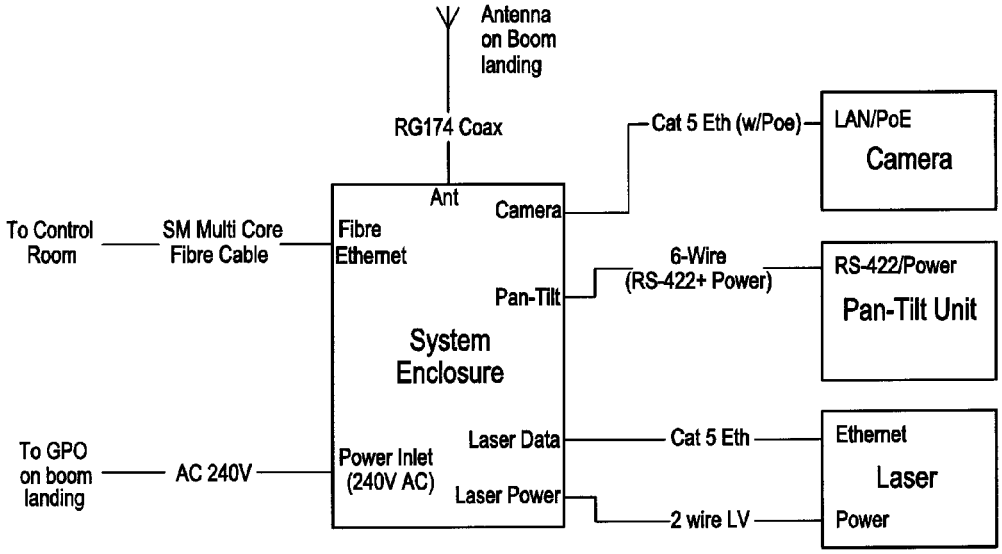
FIG. 10 is a sensor assembly schematic.

The PTU, and all boom mounted sensors were connected to an Ethernet network. As the PTU and Navigation sensor only provided a serial interface, a converter was necessary. This network of sensors was then connected to the previously mentioned fibre link. The serial converter and the network switch were housed in fibre converter were housed in a separate boom mounted enclosure, along with the navigation sensor. A schematic outline of the boom mounted hardware is shown in FIG. 10.

Supporting Hardware

Figure 11:
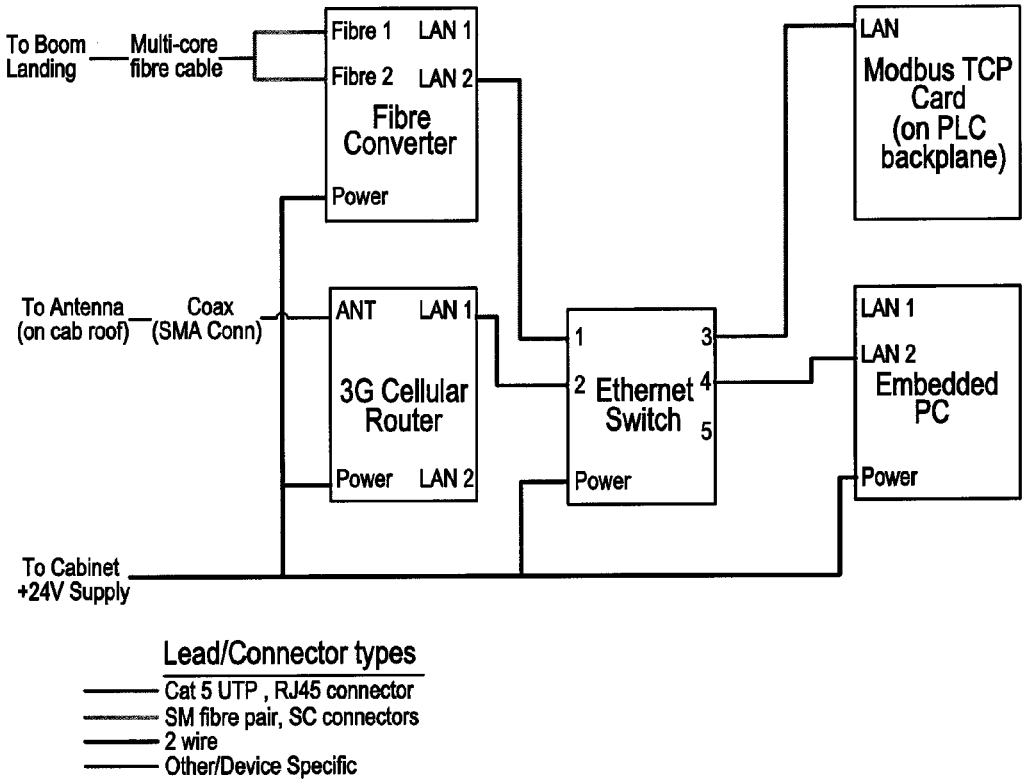
FIG. 11 is a control room networking schematic.

In the dragline control room, a network of supporting devices for purpose of computation, telemetry and interfacing with the dragline PLC were connected to the other end of the fibre link. A schematic overview of this control room network is provided in FIG. 11, with further details of the individual devices given in the sections below.

PLC Interface

The prediction of bucket movement during scanning, as well as the calculation of bulk density, necessitated the collection of data from the dragline's control system. The required data included rope lengths, rope velocities, and payload weights. For this purpose, Drives and Controls Services (DCS), the maintainer of the control system, installed and configured a Prosoft MVI56-MNETC PLC Module. This module would transmit the required data via the Modbus TCP/IP Protocol.

3G Cellular Router

To facilitate telemetry, a 3G cellular router was connected to the control room network. This router was connected to a high gain antenna mounted on the roof of the dragline operator's cab. The 3G router, used in conjunction with a dynamic DNS service would allow connection to the system over the internet.

Embedded PC

An embedded PC was connected to the control room network. The computer would allow secure remote access and run the project software.

System Software

The initial software for the scaled pilot trials was implemented in MATLAB for computing volumes from data collected in the 1:20 scaled dragline facility. The algorithms were later ported to C++ in time for the full scale installation to ensure real-time performance. Software drivers for the full scale hardware were extensively bench tested before commissioning. The real-time performance requirement of the software is that the volume computation will be completed before the third party dragline monitor reports the payload weight of the last bucket.

Figure 12:
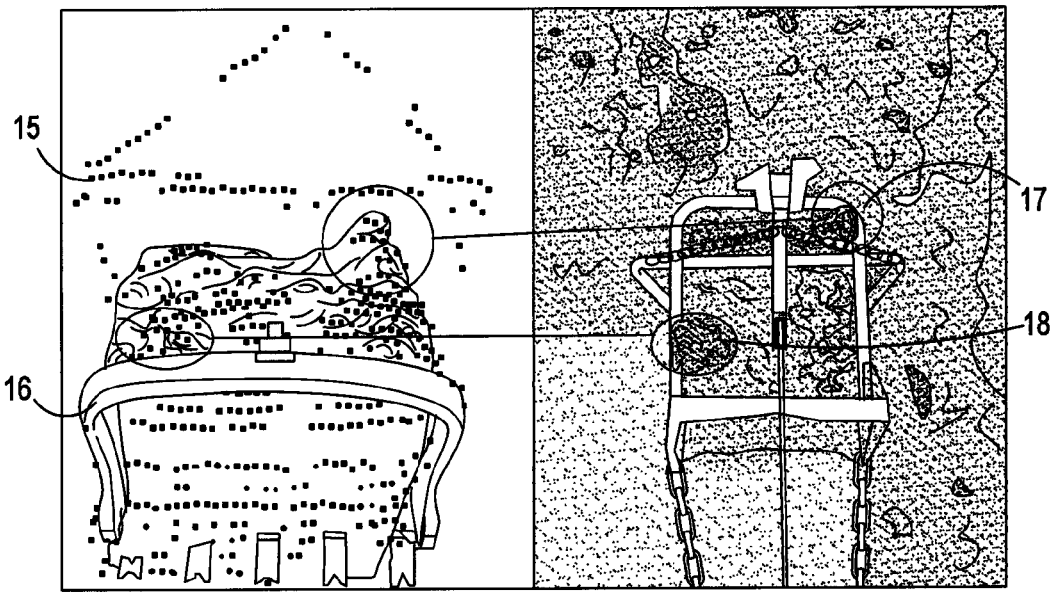
FIG. 12 shows a screen shot of the bucket visualiser, alongside a video capture of the corresponding bucket.

FIG. 12 shows an illustration of how the payload mesh looks after segmentation and filtering. The raw 3d point cloud 15 is overlaid to show that the spreader bar 16 is excluded from payload mesh generation. Typically, 800 to 1000 bucket points are collected across the bucket (including rigging) of which generally 600 or more points are used to generate the payload mesh. The visualizer is capable of showing the irregularities of the payload surface with rocks 17 extruding over the top of the payload and occasional gaps 18 in the payload when the material doesn't always fall to the rear of the bucket.

Ground Truth Data Collection Method

Figure 13:
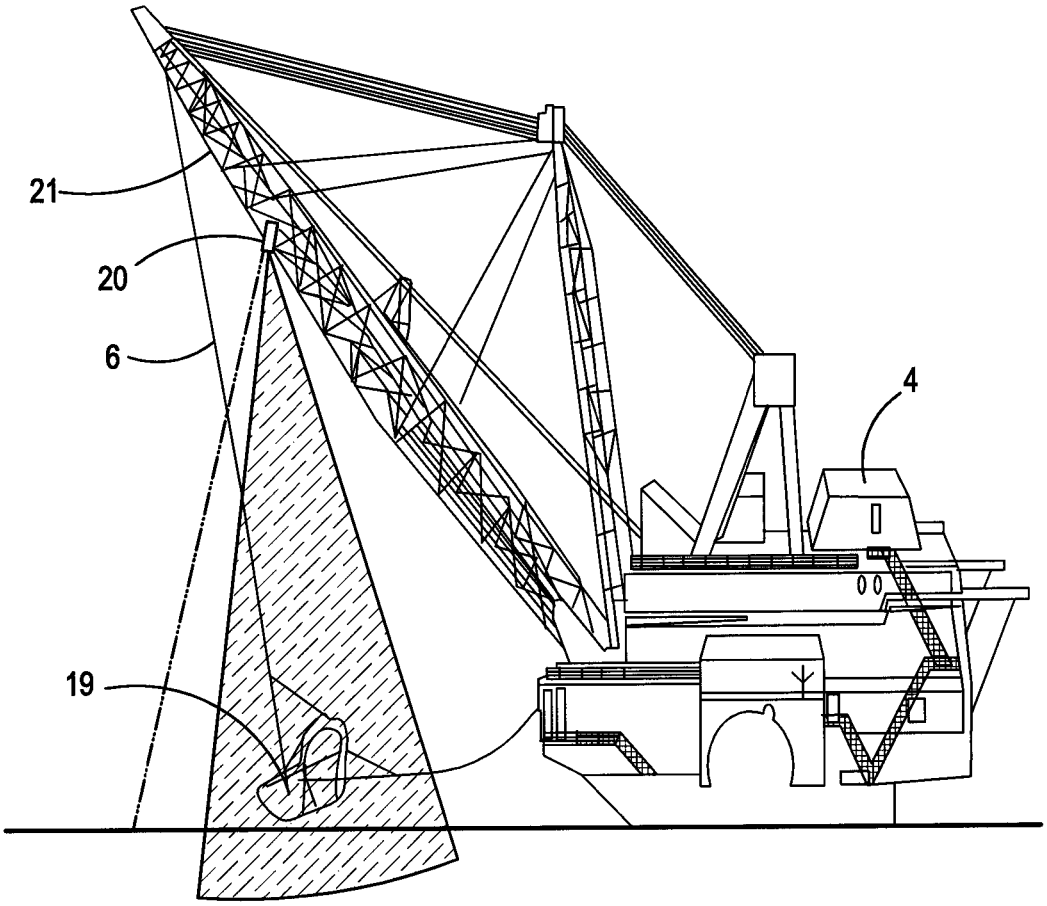
FIG. 13 is an elevation of a dragline showing ground truth static scanning.

FIG. 13 illustrates the collection of ground truth data. After the bucket 19 was pulled out of each dig the operator rested the bucket on the pad in a position directly under the laser position 20 on the boom 21. The laser then takes four high-resolution sweeps of the bucket that produce 6000 to 8000 samples across the bucket surface. This is approximately ten times the number of samples collected dynamically as the bucket moves to the dump zone.

Accuracy of Static Bucket Sweep

A static sweep of an empty bucket was carried out during the production time as a reference. Each individual sweep on the empty bucket were analysed with a volume of −0.3 cubic meters or 0.56% of the rated bucket capacity. This is considered to be an acceptable measurement error for the measurement of the ground truth data set.

Similarly the loaded bucket sweep scans were individually analysed and the median sweep volume is used for each bucket.

We claim:

1. A method of measuring, with a scanning device, bulk density of a payload having a weight, a volume, and a surface in a dragline bucket having a base and sides, during dragline operation, comprising:

scanning, by the scanning device, a loaded dragline bucket during an operating cycle of the dragline wherein the bucket is moving, to provide mathematical data relating to the surface of the payload in the loaded bucket, wherein the scanning comprises collecting scan line data from multiple scans;

calculating the volume enclosed by the surface of the payload and the base and sides of the dragline bucket from the mathematical data, wherein the calculating comprises:

analyzing the collected scan line data;

identifying a shift between scan line data from a first scan and scan line data from a second scan attributable to bucket motion between scans; and using the shift to compensate for bucket motion;

receiving a weight of the payload; and determining a bulk density of the payload by dividing the calculated volume into the weight.

2. The method of claim 1 wherein the operating cycle of the dragline comprises a lifting phase, a carry phase, and a dumping phase, and wherein scanning the loaded dragline bucket occurs during the carry phase of the operating cycle, between the lifting phase and the dumping phase.

3. The method of claim 1 wherein scanning the loaded dragline bucket comprises moving at least one of the loaded dragline bucket and a beam of the scanning device relative to the other.

4. The method of claim 3 wherein the scanning device comprises a laser scanner.

5. The method of claim 3 wherein the scanning device comprises a radar scanner.

6. The method of claim 1, further comprising analyzing, by a computing device, the mathematical data from the scanning device to screen out data that relates to surfaces other than the surface of the payload and the base and sides of the dragline bucket.

7. A computer-readable storage medium having contents configured to cause a computer to perform a method for measuring, with a scanning device, a volume of a payload having a surface in a moving dragline bucket, during dragline operation, the method comprising:

obtaining data points by scanning, with the scanning device, a loaded, moving dragline bucket during an operating cycle of the dragline;

identifying, from the obtained data points, data points associated with the bucket or the payload;

translating the data points associated with the bucket or the payload to compensate for the motion of the bucket;

determining a pose of the bucket;

filtering out, from the data points associated with the bucket or the payload, data points not associated with the payload;

estimating the payload surface using the filtered data points;

calculating, from the estimated payload surface and the determined pose, the volume of the payload.

8. A method of measuring, with a scanning device, bulk density of a payload having a weight, a volume, and a surface in a dragline bucket having a base and sides, during dragline operation, wherein the dragline bucket is connected to at least one of a hoist rope and a drag rope, comprising:

scanning, by the scanning device, a loaded dragline bucket during an operating cycle of the dragline wherein the bucket is moving, to provide mathematical data relating to the surface of the payload in the loaded bucket, wherein the scanning comprises collecting scan line data from multiple scans;

calculating the volume enclosed by the surface of the payload and the base and sides of the dragline bucket from the mathematical data, wherein the calculating comprises:

collecting hoist rope and drag rope length data for a first scan and for a second scan; and using the collected hoist rope and drag rope length data to determine a change in position of the loaded dragline bucket between the first scan and the second scan;

receiving a weight of the payload; and determining a bulk density of the payload by dividing the calculated volume into the weight.

9. A method of measuring, with a scanning device, bulk density of a payload having a weight, a volume, and a surface in a dragline bucket having a base and sides, during dragline operation, comprising:

scanning, by the scanning device, a loaded dragline bucket during an operating cycle of the dragline wherein the bucket is moving, to provide mathematical data relating to the surface of the payload in the loaded bucket, wherein the scanning comprises collecting scan line data from multiple scans;

calculating the volume enclosed by the surface of the payload and the base and sides of the dragline bucket from the mathematical data, wherein the calculating comprises:

determining a velocity of the loaded dragline bucket;

measuring a displacement of position of the loaded dragline bucket between a first scan and a second scan as a function of the determined velocity of the loaded dragline bucket; and using the measured displacement to scale the mathematical data relating to the scanned surface of the payload;

receiving a weight of the payload; and determining a bulk density of the payload by dividing the calculated volume into the weight.

10. The method of claim 9 wherein the loaded dragline bucket has a pose, and wherein features of the dragline bucket are known, and wherein calculating the volume enclosed by the surface of the payload and the base and sides of the bucket comprises:

determining the pose of the loaded bucket; and filtering out known features of the bucket from the volume calculation.

11. The method of claim 9 wherein calculating the volume enclosed by the surface of the payload and the base and sides of the dragline bucket comprises using a height grid representation.

12. The method of claim 9 wherein the surface of the payload is irregular, such that scanning the loaded dragline bucket comprises identifying portions of the surface extending above or below an average height of the surface.

13. The computer-readable storage medium of claim 7 wherein:

obtaining data points comprises collecting, from a laser scanner or radar scanner, data from multiple scan lines that are substantially orthogonal to the payload surface;

identifying data points associated with the bucket or the payload comprises:

classifying data points as terrain, bucket or noise; and using point clustering to identify similar points within the scan;

translating data points associated with the bucket or the payload to compensate for motion of the bucket comprises:

determining a velocity of the loaded dragline bucket;

using the determined velocity to scale the data points to compensate for bucket travel;

translating data points by their mean x coordinate to compensate for bucket sway; and smoothing data points by applying a polynomial or sine wave fit;

determining the pose of the bucket comprises identifying data points corresponding to reflectors attached to the bucket or using an iterative closest point algorithm;

filtering data points not associated with the payload comprises:

filtering data points associated with a dragline bucket arch, a spreader bar, a rope, or noise; and filtering data points within a defined geometric shape representing a bucket feature; and estimating the payload surface using the filtered data points comprises:

using a height grid representation of the surface;

identifying irregular portions of the surface including material extending above or gaps below an overall shape of the surface; and interpolating data points to form a continuous surface.

14. The computer-readable storage medium of claim 7 wherein identifying data points associated with the bucket or the payload comprises classifying data points as terrain, bucket or noise.

15. The computer-readable storage medium of claim 7 wherein identifying data points associated with the bucket or the payload comprises using point clustering to identify similar points within the scan.

16. The computer-readable storage medium of claim 7 wherein translating data points associated with the bucket or the payload to compensate for motion of the bucket comprises translating data points by their mean x coordinate to compensate for bucket sway or rescaling data points to compensate for bucket travel.

17. The computer-readable storage medium of claim 7 wherein translating data points associated with the bucket or the payload to compensate for motion of the bucket comprises smoothing data points by applying a polynomial or sine wave fit.

18. The computer-readable storage medium of claim 7 wherein determining the pose of the bucket comprises identifying data points corresponding to reflectors attached to the bucket or using an iterative closest point algorithm.

19. The computer-readable storage medium of claim 7 wherein filtering data points not associated with the payload comprises filtering data points associated with a dragline bucket arch, a spreader bar, a rope, or noise.

20. The computer-readable storage medium of claim 19 wherein filtering data points not associated with the payload comprises filtering data points within a defined geometric shape representing a bucket feature.

21. The computer-readable storage medium of claim 7 wherein estimating the payload surface using the filtered data points comprises interpolating data points to form a continuous surface.

* * * * *